US009617701B2

(12) United States Patent
Yun et al.

(10) Patent No.: US 9,617,701 B2
(45) Date of Patent: Apr. 11, 2017

(54) MULTI-STAGE EXTENDING GROUND ANCHOR ASSEMBLY

(71) Applicant: Jangpyoung Construction Co., LTD., Seoul (KR)

(72) Inventors: Young-Su Yun, Seoul (KR); Byeong-Kwan Na, Incheon (KR)

(73) Assignee: JANGPYOUNG CONSTRUCTION CO., LTD., Seoul (KR)

( * ) Notice: Subject to any disclaimer, the term of this patent is extended or adjusted under 35 U.S.C. 154(b) by 0 days.

(21) Appl. No.: 14/697,676

(22) Filed: Apr. 28, 2015

(65) Prior Publication Data

US 2015/0308065 A1 Oct. 29, 2015

(30) Foreign Application Priority Data

Apr. 28, 2014 (KR) ..... 10-2014-0050571

(51) Int. Cl.
*E02D 5/80* (2006.01)

(52) U.S. Cl.
CPC ..... *E02D 5/803* (2013.01); *E02D 5/80* (2013.01); *E02D 5/805* (2013.01)

(58) Field of Classification Search
CPC E02D 5/803; E02D 5/805; E02D 5/80; E02D 5/801; E02D 5/28; E04H 12/223; E04H 12/2223
USPC ..... 52/113, 114, 153–165
See application file for complete search history.

(56) References Cited

U.S. PATENT DOCUMENTS 787,017 A * 4/1905 Witmer ..... E02D 5/803 52/160
977,757 A * 12/1910 Stewart ..... E02D 5/803 52/161
2,176,566 A * 10/1939 Dillon ..... E02D 5/803 52/160
2,343,350 A * 3/1944 Warren ..... B64F 1/12 52/156
2,490,465 A * 12/1949 Ogburn ..... E02D 5/803 52/164
2,576,412 A * 11/1951 Ogburn ..... E02D 5/803 52/161
3,763,610 A * 10/1973 Ballew ..... E02D 5/80 52/160
3,803,782 A * 4/1974 Ballew ..... E02D 5/803 52/161
4,178,726 A * 12/1979 Watson ..... E02D 5/803 411/914

(Continued)

FOREIGN PATENT DOCUMENTS

KR 1020120085352 * 8/2012 ..... E02D 5/803
KR 1020120092358 8/2012

*Primary Examiner* — Phi A
*Assistant Examiner* — Omar Hijaz
(74) *Attorney, Agent, or Firm* — Hunter E. Webb; Keohane & D'Alessandro PLLC

(57) ABSTRACT

In general, embodiments of the present invention relate to ground anchor assemblies. Specifically, the present invention provides a multi-stage extending ground anchor assembly including wing members that are coupled to a fixing member of the ground anchor assembly. The wing members are configured to make contact with an inner wall of a ground hole such that the earth anchor assembly can be used in surfaces of any consistency, including both bedrock and soft surfaces.

3 Claims, 9 Drawing Sheets

(56) References Cited

U.S. PATENT DOCUMENTS

| | | | | |
|---|---|---|---|---|
| 7,059,263 | B1 * | 6/2006 | Zimmerman | B63B 21/243<br>114/301 |
| 2003/0115810 | A1 * | 6/2003 | Reinert, Sr. | E02D 5/803<br>52/156 |
| 2005/0210771 | A1 * | 9/2005 | Kuenzel | F16B 13/0833<br>52/155 |

* cited by examiner

A-A′

MULTI-STAGE EXTENDING GROUND ANCHOR ASSEMBLY

CROSS-REFERENCE TO RELATED APPLICATION

This application claims the benefit of Korean patent application No. 10-2014-0050571, filed Apr. 28, 2014.

TECHNICAL FIELD

The present invention relates to ground anchor assemblies. Specifically, the present invention provides a multi-stage extending ground anchor assembly including wing members that pivotally unfold to firmly fasten to the inner wall of a ground hole such that the earth anchor assembly can be used in surfaces of any consistency, including both bedrock and soft surfaces.

BACKGROUND

Anchoring is a construction method used to support structures by anchors in various geotechnical and construction applications, such as building up bridges, plants, dams, or tunnels. Various types of anchors are currently in use for structure support. Among them, permanent anchors may be employed for slope stabilization. These types of anchors, in use, are usually inserted into ground holes formed in a slope.

A permanent anchor typically includes a fixed anchor part, a free anchor part, and an anchor head. In such a configuration, the fixed anchor part is positioned near the bottom of the ground hole in the slope, and the free anchor part is positioned from above the fixed anchor part to the top surface of the slope. The anchor head secures the anchor to the slope. A pullout rod may be connected to the permanent anchor.

In a typical anchoring process using a permanent anchor, the anchor is inserted into a ground hole formed in a slope. The pullout rod is strained from outside the slope. The ground hole is then filled with a filler material such as mortar or concrete, and the filler is hardened. The pullout rod exposed to the outside of the slope is fastened to a position by way of a pressing plate, for instance. In order to create a strong tensile force, the anchor should be able to "bite" into the inner wall of the ground hole.

SUMMARY

In general, embodiments of the present invention relate to ground anchor assemblies. Specifically, the present invention provides a multi-stage extending ground anchor assembly including wing members that are pivotally coupled to a fixing member of the ground anchor assembly. The wing members are configured to make with an inner wall of a ground hole such that the earth anchor assembly can be used in surfaces of any consistency, including both bedrock and soft surfaces.

One aspect of the present invention provides a multi-stage extending earth anchor assembly for installing in a ground hole, comprising: a fixing member configured to receive at least a portion of a moving member, wherein the moving member is positioned below the fixing member, wherein the moving member includes a base portion and an elongated portion, wherein the elongated portion includes at least one inclined surface; a plurality of wing members pivotally hinged to the fixing member, wherein each of the plurality of wing members include one or more fixing latches on its outer surface; a primary compressor configured to provide a first movement of the moving member in a direction of the fixing member along a longitudinal axis formed by the combination of the fixing member and moving member such that the fixing member and moving member become compressed, wherein the compression causes a contact between the plurality of wing members and the at least one inclined surface; and the plurality of wing members further configured to move laterally away from the longitudinal axis based on the contact between the plurality of wing members and the at least one inclined surface causing the one or more fixing latches to make contact with an inner wall of the ground hole.

A second aspect of the present invention provides a method for installing an earth anchor assembly in a ground hole, comprising: inserting the earth anchor assembly into the ground hole, wherein the earth anchor assembly includes a fixing member and a moving member, wherein the fixing member configured to receive at least a portion of a moving member, wherein the moving member is positioned below the fixing member, wherein the moving member includes a base portion and an elongated portion, wherein the elongated portion includes at least one inclined surface; providing a first movement of the moving member in a direction of the fixing member along a longitudinal axis formed by the combination of the fixing member and moving member such that the fixing member and moving member become compressed, wherein the compression causes a contact between the plurality of wing members and the at least one inclined surface; and moving the plurality of wing members laterally away from the longitudinal axis based on the contact between the plurality of wing members and the at least one inclined surface causing the one or more fixing latches to make contact with an inner wall of the ground hole.

BRIEF DESCRIPTION OF THE DRAWINGS

These and other features of this invention will be more readily understood from the following detailed description of the various aspects of the invention taken in conjunction with the accompanying drawings in which.

Figure 1:
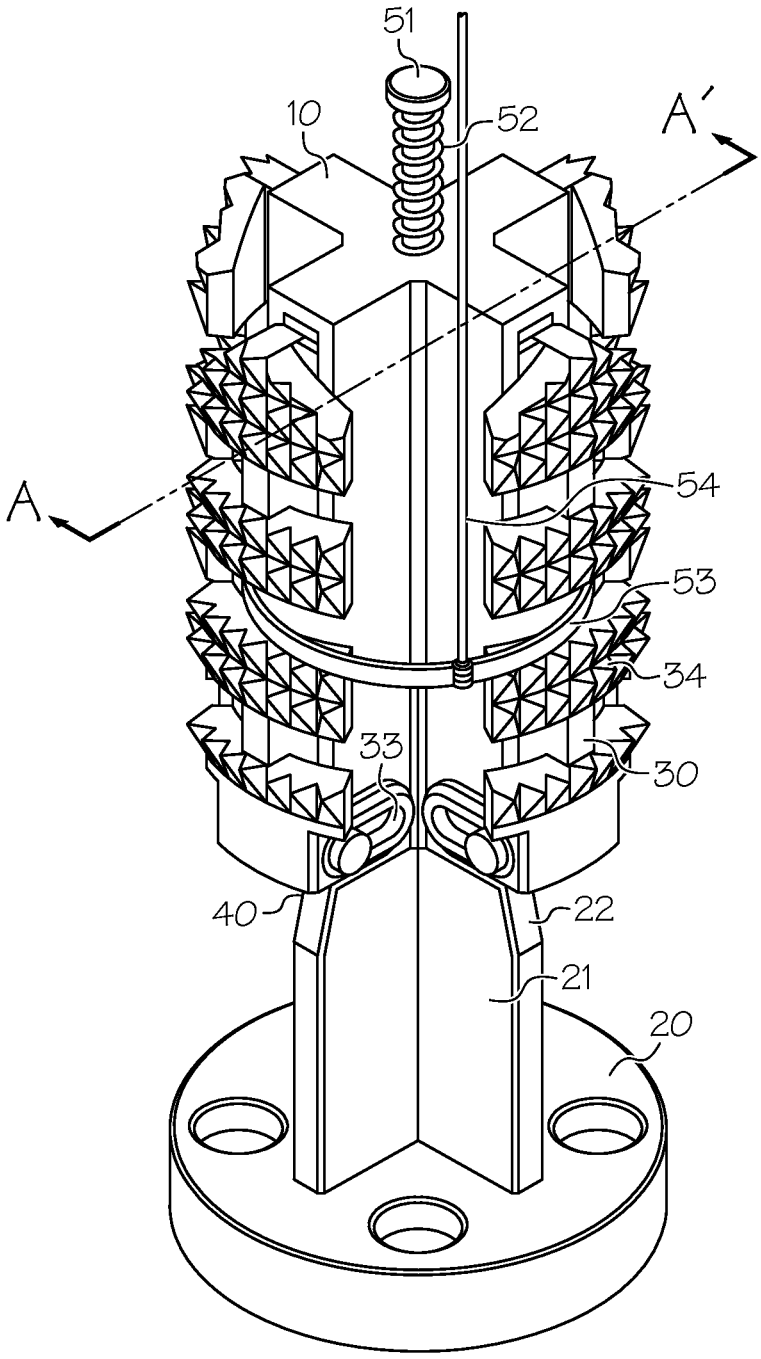
FIG. 1 is a perspective view illustrating a multi-stage extending earth anchor assembly according to an embodiment of the present invention.

The drawings are not necessarily to scale. The drawings are merely schematic representations, not intended to portray specific parameters of the invention. The drawings are intended to depict only typical embodiments of the invention, and therefore should not be considered as limiting the scope of the invention. In the drawings, like numbering represents like elements.

DETAILED DESCRIPTION

Illustrative embodiments will now be described more fully herein with reference to the accompanying drawings, in which exemplary embodiments are shown. This disclosure may, however, be embodied in many different forms and should not be construed as limited to the embodiments set forth herein. Rather, these illustrative embodiments are provided so that this disclosure will be thorough and complete and will fully convey the scope of this disclosure to those skilled in the art. In the description, details of well-known features and techniques may be omitted to avoid unnecessarily obscuring the presented embodiments.

The terminology used herein is for the purpose of describing particular embodiments only and is not intended to be limiting of this disclosure. As used herein, the singular forms "a", "an", and "the" are intended to include the plural forms as well, unless the context clearly indicates otherwise. Furthermore, the use of the terms "a", "an", etc., do not denote a limitation of quantity, but rather denote the presence of at least one of the referenced items. It will be further understood that the terms "comprises" and/or "comprising", or "includes" and/or "including", when used in this specification, specify the presence of stated features, regions, integers, steps, operations, elements, and/or components, but do not preclude the presence or addition of one or more other features, regions, integers, steps, operations, elements, components, and/or groups thereof.

It will be further understood that when an element or layer is referred to as being "on," "connected to," "coupled to," or "adjacent to" another element or layer, it can be directly on, connected, coupled, or adjacent to the other element or layer, or intervening elements or layers may be present.

As denoted herein, the terms "laterally" and "in a/the lateral direction" may be interchangeably used. As denoted herein, the terms "upward(s)" and "downward(s)" may be interchangeably used with the terms "in the upper direction" and "in the lower direction," respectively. As used herein, the term "lateral" or "lateral direction" may refer to a direction substantially parallel with the bottom of an aperture (e.g., a ground hole).

As indicated above, embodiments of the present invention relate to ground anchor assemblies. Specifically, the present invention provides a multi-stage extending ground anchor assembly including wing members that are pivotally coupled to a fixing member of the ground anchor assembly. The wing members are configured to make contact with an inner wall of a ground hole such that the earth anchor assembly can used in surfaces of any consistency, including both bedrock and soft surfaces.

With reference to FIGS. 1-3 and 5-8, a multi-stage extending ground anchor assembly shaped and dimensioned for secure attachment within a support surface is disclosed. The ground anchor assembly is adapted to anchoring within surfaces of any consistency, including both bedrock and soft surfaces, although those skilled in the art will certainly appreciate other applications might be achieved without departing from the spirit of the present invention. It is contemplated the ground anchor assembly will be particularly useful in various geotechnical and construction applications, although those skilled in the art certainly appreciate a wide variety of uses.

Figure 2:
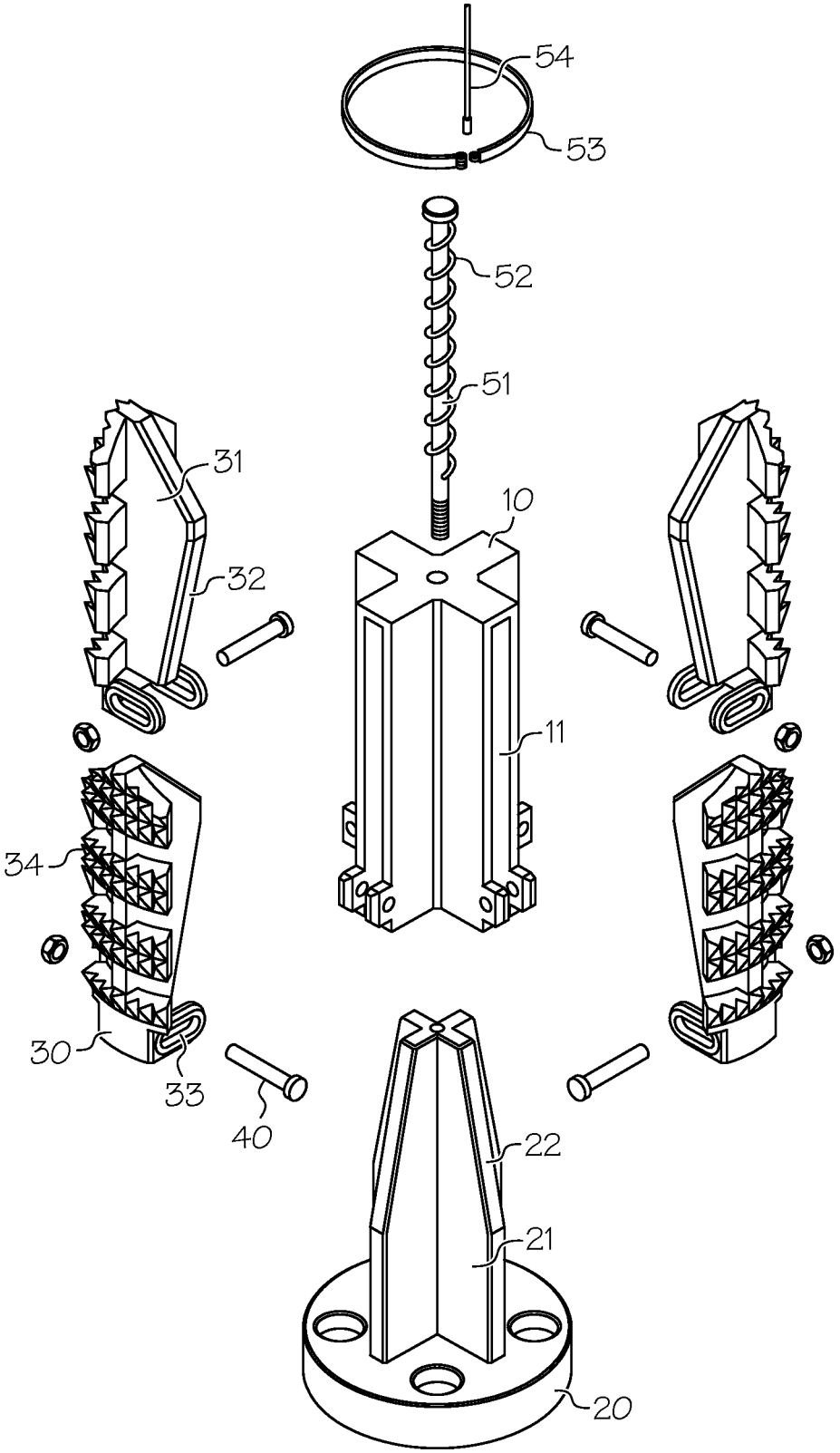
FIG. 2 is an exploded perspective view illustrating a multi-stage extending earth anchor assembly according to an embodiment of the present invention.
Figure 3:
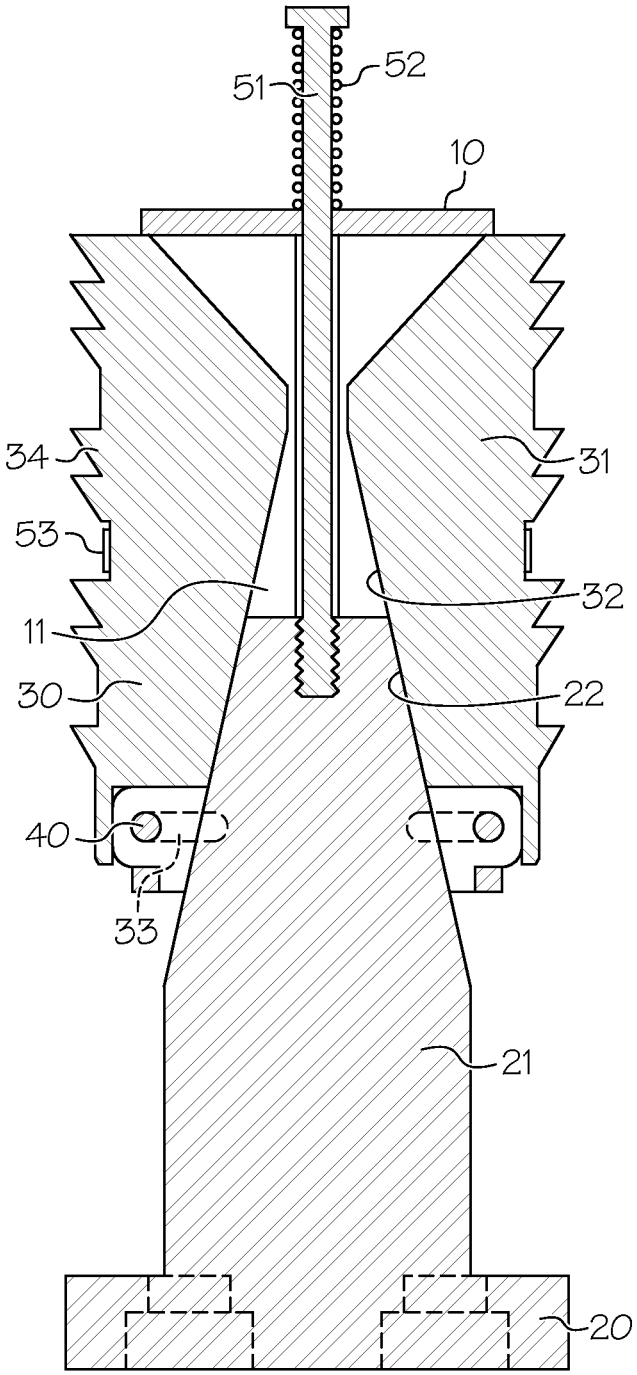
FIG. 3 is a cross-sectional view taken along line A-A' of FIG. 1 according to an embodiment of the present invention.

FIG. 1 is a perspective view illustrating a multi-stage extending earth anchor assembly, or simply "anchor assembly". FIG. 2 is an exploded perspective view illustrating an earth anchor assembly. FIG. 3 is a cross-sectional view of an earth anchor assembly taken along line A-A' (shown in FIG. 1). With reference to FIGS. 1-3, the earth anchor assembly includes a fixing member 10, a moving member 20, guiding flanges 21, inclined surfaces 22, wing members 30, sliding slots 33, fixing latches 34, rotational pins 40, a rotational coupler 51, a primary compressor 52, a band member 53, and a band release 54. Additionally, FIGS. 2-3 show guiding holes 11, ridges 31, and elevated surfaces 32. The earth anchor assembly parts are discussed in detail below.

As shown, the earth anchor assembly includes fixing member 10 and moving member 20. Fixing member 10 and/or moving member 20 can comprise one or more of the following materials: stainless steel, aluminum, titanium, other metals, plastics, ceramics, carbon fiber and/or the like. Fixing member 10 has an elongated body portion and at least one channel oriented substantially parallel to a longitudinal axis. In embodiments of the invention, the at least one channel can be internal to the body of fixing member 10 while in other embodiments, one or more of the at least one channel can be at least partially external to the fixing member 10. To this extent, fixing member can take any shape that is consistent with these features. In an embodiment, fixing member 10 may have a cross section shaped as a plus ("+") sign. Fixing member 10 also includes a coupling apparatus for coupling a plurality of wing members 30, as will be described hereinafter.

Moving member 20 includes a base portion and an elongated portion. The base portion may be a circular shape (as shown in FIGS. 2-3) or non-circular shape. Moving member 20 coupled to fixing member 10 via the at least one channel and is positioned with an orientation along the longitudinal axis of the fixing member (e.g., below fixing member 10 when the earth assembly anchor is positioned vertically in an aperture, such as a ground hole). Fixing member 10 is adapted to receive at least a portion of the elongated portion of moving member 20 via the at least one channel. In addition, the base portion of moving member 20 can include couplers for coupling to a secondary compressor 70 as will be described hereinafter.

The elongated portion of moving member 20 can include one or more guiding flanges 21 which fit within the one or more channels, allowing moving member 20 to move along a lateral axis with respect to fixing member 10 (e.g., to slide up and down with respect to fixing member when the earth assembly anchor is positioned vertically in an aperture, such as a ground hole).

Moving member 20 can have a cross section that is shaped in a way that corresponds to the shape of the cross section of fixing member 10 (e.g., shaped as a plus sign). As shown, four guiding flanges 21 are used to form the elongated portion (and thus forming the plus sign) of moving member 20. In other examples, moving member 20 can include more or fewer guiding flanges 21 or, alternatively, a different solution can be used to couple moving member 20 with respect to the one or more channels of fixing member 10.

In any case, the elongated portion of moving member 20 also includes one or more inclined surfaces 22. The elongated portion can have a single inclined surface 22 forming all or substantially all of an outer surface of at least a portion (longitudinally) of the elongated portion. Alternatively, the elongated portion can included a plurality of inclined surface spaced about a portion (longitudinally) of the elongated portion. In cases in which guiding flanges 21 are utilized, each guiding flange 21 can include at least one inclined surface 22. In any case, inclined surface 22 inclines from a portion of the elongated portion of moving member 20 relatively closer to the fixing member 10 when the fixing member 10 and the moving member 20 are in a non-compressed state. Contact between a wing member 30 and included surface 22 causes wing member 30 to move laterally away from a longitudinal axis of the fixing member 10 and moving member 20 combination.

The elongated portion of moving member 20 can have a relatively level elevated surface 32 at a portion of the inclined surface 22 farthest from the fixing member 10 when the fixing member 10 and moving member 20 are in a non-compressed state. Contact between a wing member 30 and an elevated surface 32 causes the wing member 30 to rotate about rotational coupler 51 with respect to the longitudinal axis of the fixing member 10 and moving member 20 combination.

Wing members 30 are pivotally coupled to fixing member 10. Each wing member 30 may include at least one rotational coupler 40 used to pivotally couple the respective bottom portion of the wing member 30 to fixing member 10 (e.g., to coupling apparatus). Each wing member 30 may include one or more fixing latches 34 formed all along its outer surface facing outward. The fixing latches are configured to "bite" or dig into an inner wall of a ground hole. The earth anchor assembly may include more or fewer wing members 30 than the sixteen wing members 30 shown in FIGS. 1-2. Each of the wing members 30 includes one or more elevated surfaces 32 above the incline surfaces 22. Any one or more of the bottom portions of the wing members 30 and the fixing member 10 can have sliding slots 33 elongated in a lateral direction along which the wing members 30 can move.

The surface of a wing member 30 farthest from the longitudinal axis of the fixing member 10/moving member 20 combination can be textured to provide increased friction between wing member 30 and surface of the aperture. The texturing can include grooves, indentions, protrusions, ridges, or the like.

The surface of wing member 30 closest to moving member 20 when the structure is in a non-compressed state is an angled surface that substantially matches the angle of the inclined surface 22 of moving member 20. Compression of the structure by primary compressor 52 or secondary compressor 70 causes the angled surface of wing member 30 to contact the inclined surface 22 of moving member 20. Further compression causes the angled surface to move along inclined surface 22 in surface contact. The contact causes the wing members 30 to move laterally away from the longitudinal axis of the fixing member 10/moving member 20 combination.

Still further compression causes the angled surface to come into contact with elevated surface 32 of moving member 20. The contact causes the wing member 30 to rotate about rotational coupler 51 with respect to the longitudinal axis of the fixing member 10/moving member 20 combination. The contact causes a portion of the wing member 30 nearest the moving member 20 to remain relatively stationary with respect to the longitudinal axis of the fixing member 10/moving member 20 combination. The contact causes a portion of the wing member 30 farthest from the moving member 20 to move laterally farther (or pivotally unfold) with respect to the longitudinal axis of the fixing member 10/moving member 20 combination.

The earth anchor assembly further includes rotational coupler 51 which passes through fixing member 10 from above fixing member 10 and is coupled with moving member 20 at an top portion of moving member 20. Rotational coupler 51 may include, among other things, a pin, dowel, or bolt. Rotational coupler 51 is housed within a rotational coupler housing located on fixing member 10. The rotational coupler housing allows rotational coupler 51 to move laterally with respect to a longitudinal axis of the fixing member 10 and moving member 20 combination as wing member 30 does the same. The rotational coupler housing includes a retaining apparatus (not shown) that is laterally further from the longitudinal axis of the fixing member 10 and moving member 20 combination than elevated surface 32. Impact of rotational coupler 51 and the retaining apparatus causes the wing member 30 to begin its rotation about the rotational coupler 51 with respect to the longitudinal axis of the fixing member 10 and moving member 20 combination.

Primary compressor 52 may include a spring or other compression means. Primary compressor 52 wraps around the rotational coupler 51. Primary compressor 52 is pressed down as the moving member 20 descends away from the fixing member 10, gaining an elastic restoring force. This elastic restoring force is released upon activation of the primary compressor 52, causing the moving member 20 to move in a direction of the fixing member along the longitudinal axis of the fixing member 10 and moving member 20 combination such that the fixing member 10 and moving member 20 combination becomes compressed.

Secondary compressor 70 may include a pulling line such as a steel wire, cable, rope, rod, or the like. One end of secondary compressor 70 may be connected outside of a ground hole. Secondary compressor 70 further moves moving member 20 in a direction of fixing member 20 along the longitudinal axis of the fixing member 10 and moving member 20 combination such that the fixing member 10 and moving member 20 combination becomes further compressed.

Figure 4A:
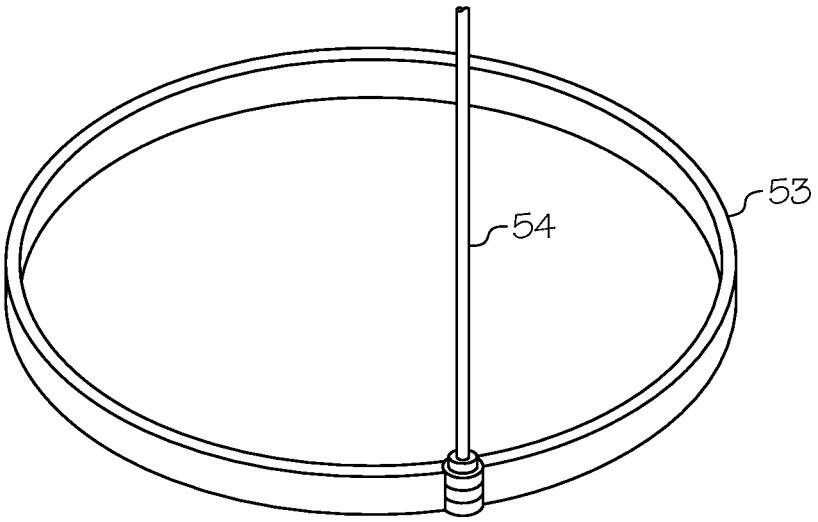
FIGS. 4A-B are views illustrating a process of releasing a band member using a releasing part according to an embodiment of the present invention.
Figure 4B:
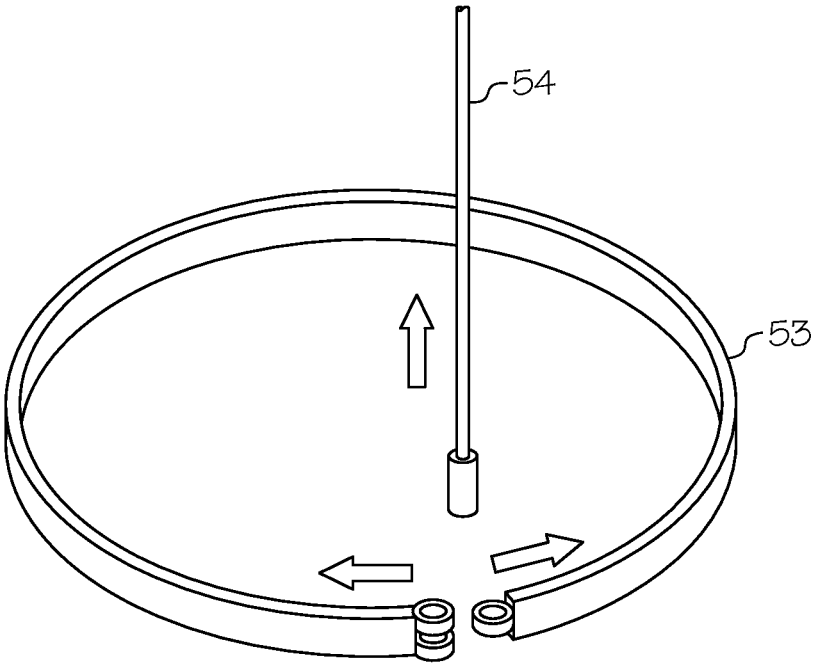

The earth anchor assembly further includes a band member 53 and a band release 54. Band member 53 is shaped as a rounded strap and mounted to surround an outer peripheral surface of the wing members 30 in order to stop the wing members 30 from arbitrarily unfolding. Band member retains the elastic restoring force of primary compressor 52 when the earth anchor assembly is in a fully uncompressed state (e.g., the moving member 20 is at its furthest point along the longitudinal axis from fixing member 10). Band release 54 releases the strap-shaped band member 53 so that the ends of band member 53 separate, causing primary compressor 52 to compress earth anchor assembly. FIGS. 4A-B are views illustrating a process of releasing band member 53 using band release 54. Band release 54 is not limited to the above-described structure and may have other various structures that allow the band member 53 to be released.

Figure 5:
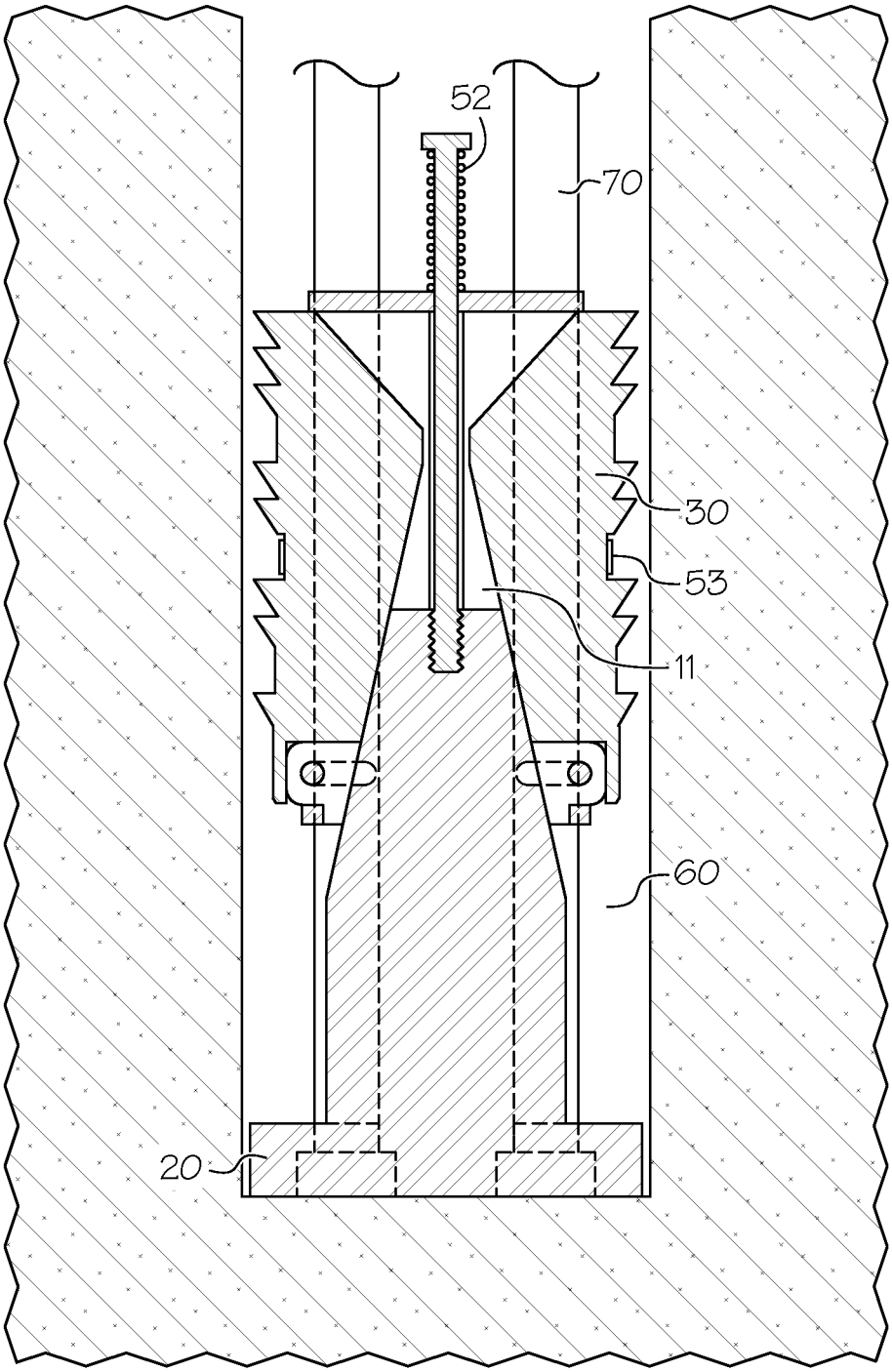
FIG. 5 is a view illustrating an example in which a multi-stage extending earth anchor assembly is inserted in an aperture (e.g., a ground hole) according to an embodiment of the present invention.
Figure 6:
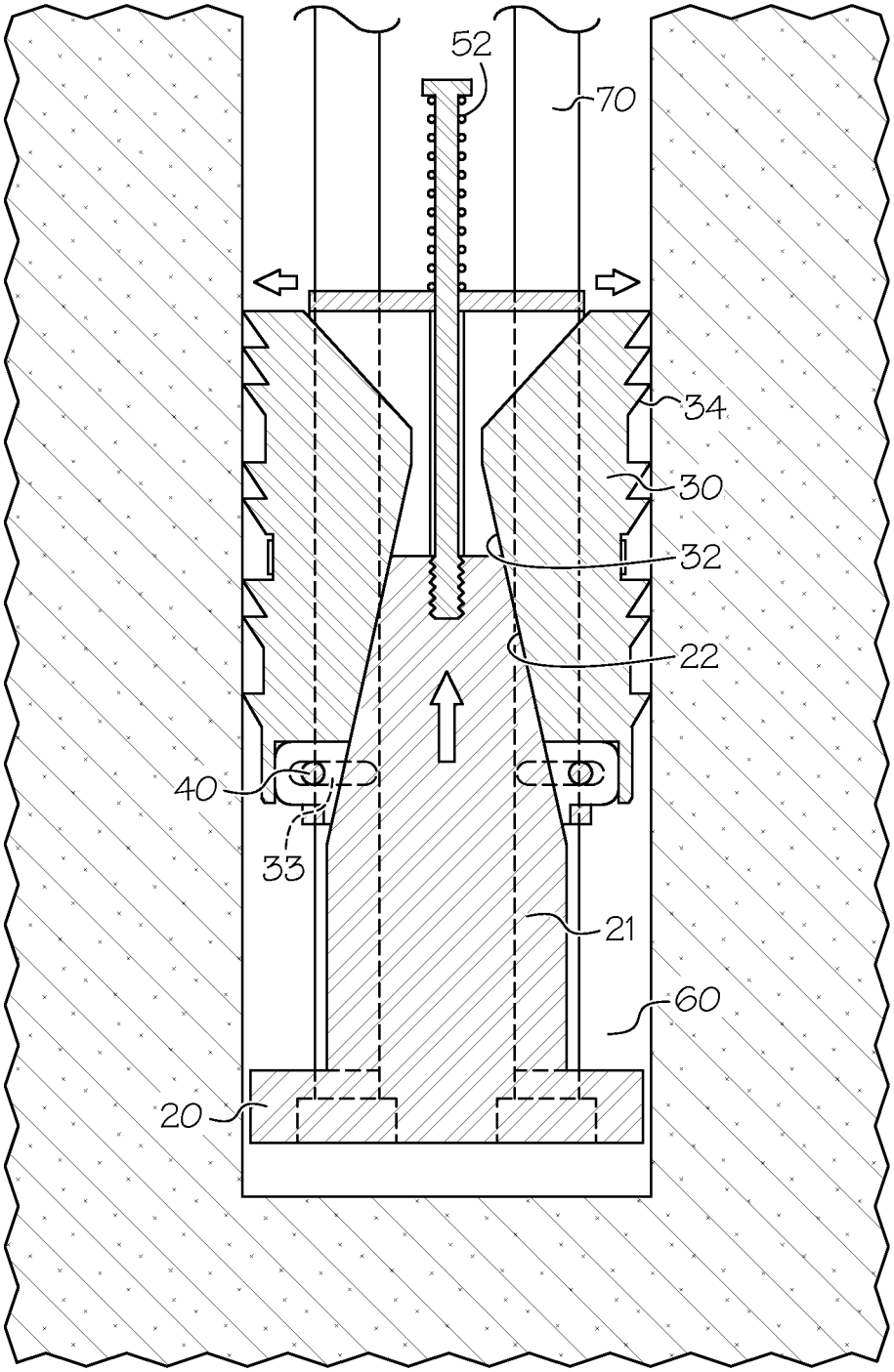
FIG. 6 is a view illustrating the multi-stage extending earth anchor assembly of FIG. 5 with the band member released according to an embodiment of the present invention.
Figure 7:
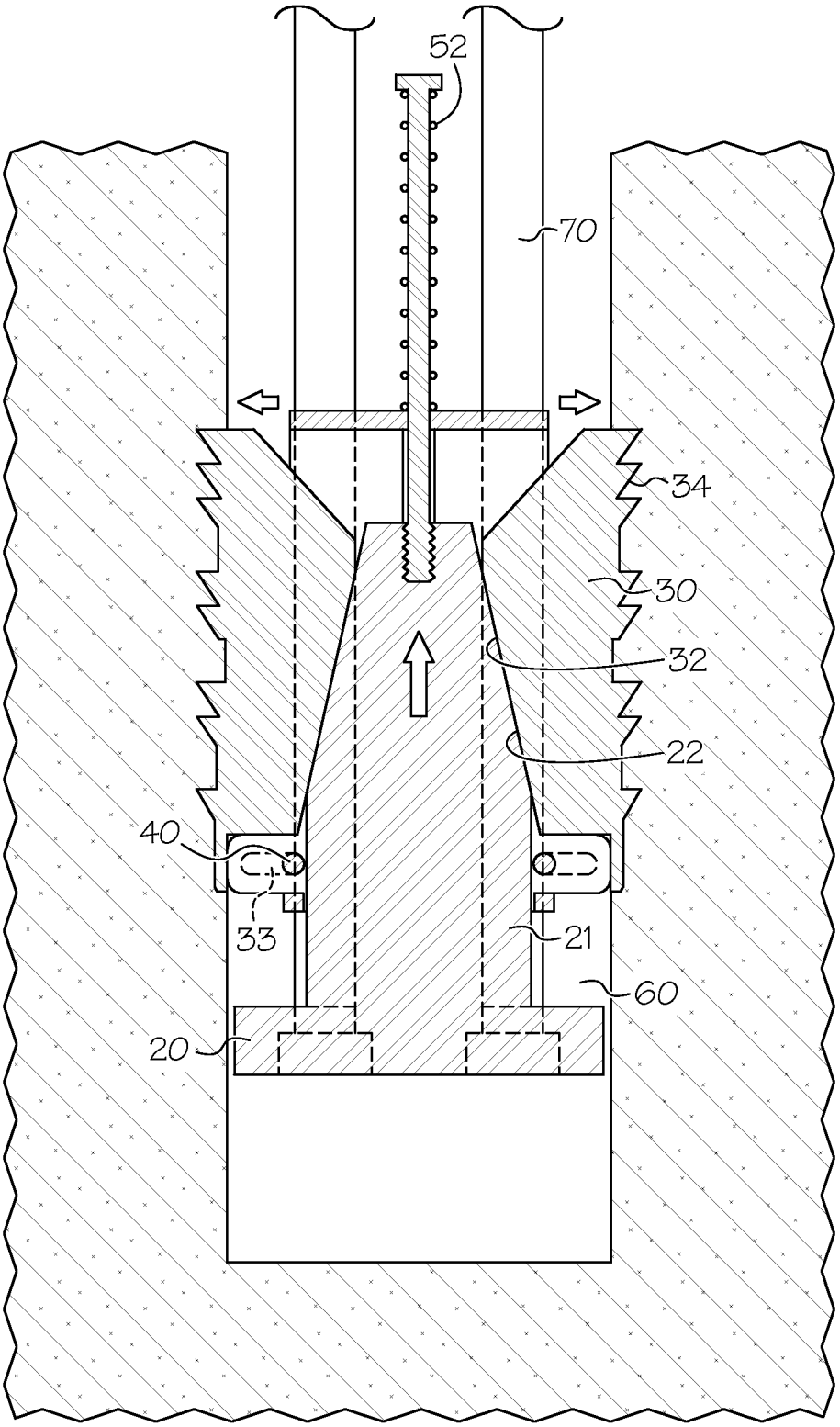
FIG. 7 is a view illustrating the multi-stage extending earth anchor assembly of FIG. 6 with the moving member ascending toward the fixing member after first compression according to an embodiment of the present invention.
Figure 8:
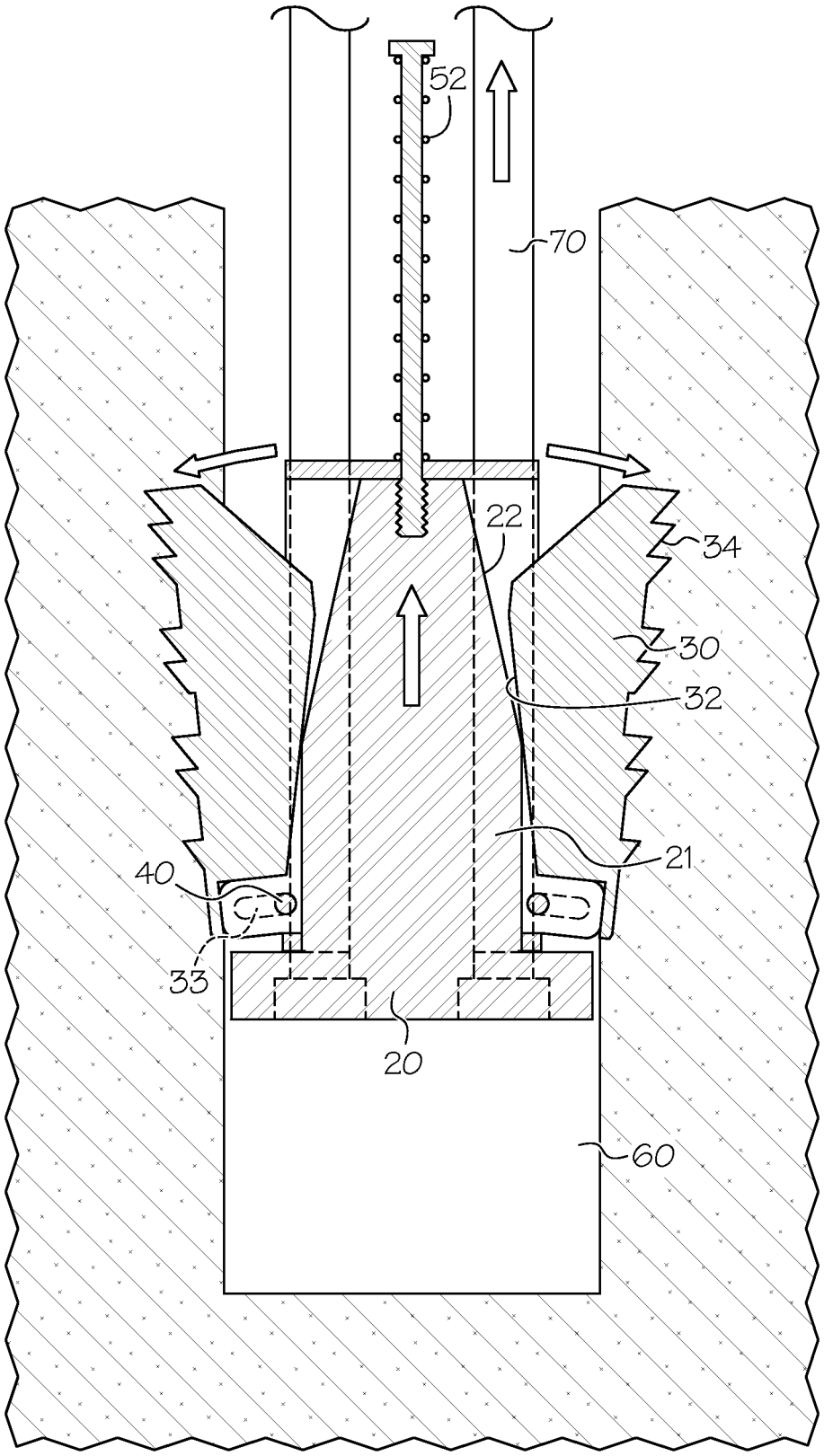
FIG. 8 is a view illustrating the multi-stage extending earth anchor assembly of FIG. 7 with the moving member further ascending toward the fixing member after second compression according to an embodiment of the present invention.

With reference to FIGS. 5-9, a process of installing a multi-stage extending earth anchor assembly as configured above in a ground hole is described in detail below. FIG. 5 is a view illustrating an example in which a multi-stage extending earth anchor assembly is inserted in a ground hole. FIG. 6 is a view illustrating the multi-stage extending earth anchor assembly of FIG. 5 with the band member released. FIG. 7 is a view illustrating the multi-stage extending earth anchor assembly of FIG. 6, with the moving member ascending after first compression. FIG. 8 is a view illustrating the multi-stage extending earth anchor assembly of FIG. 7, with the moving member 20 ascending after second compression.

Figure 9:
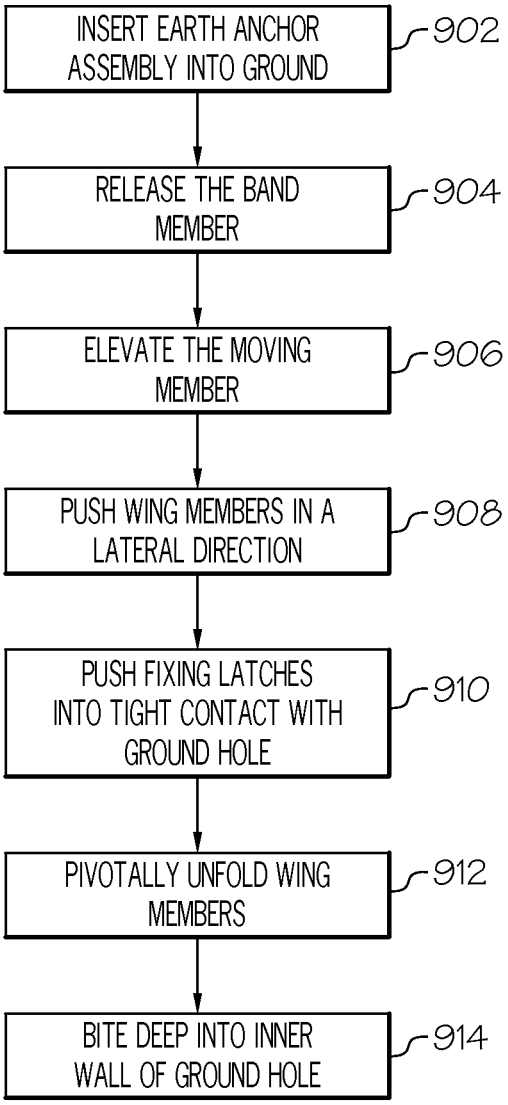
FIG. 9 is a flow diagram illustrating the process of installing a multi-stage extending earth anchor assembly according to an embodiment of the present invention.

FIG. 9 is a flow diagram illustrating the process of installing a multi-stage extending earth anchor assembly according to an embodiment of the present invention. At 902, the earth anchor assembly is inserted into the ground hole 60, starting with the bottom portion of the assembly, as shown in FIG. 5. While inserted into the ground hole 60, the earth anchor assembly stays connected with secondary compressor 70. At 904, when the earth anchor assembly is positioned in place in the ground hole 60, band member 53 is released via band release 54. At 906, the moving member 20 is then elevated by the elastic restoring force of the primary compressor 52 as shown in FIG. 6.

At 908, as the moving member 20 moves in a direction of the fixing member 10, the guiding flanges 21 are moved up, pushing each wing member 30 into contact with inclined surface 22 as shown in FIG. 7. As described above, contact between a wing member 30 and inclined surface 22 causes the wing member 30 to move laterally away from a longitudinal axis formed by the combination of fixing member 10 and moving member 20. The wing members 30 can travel along the sliding slots 33 formed laterally through the respective bottom portions of the wing members 30. The wing members 30 move in a way that the longitudinal axis of the wing members 30 remain substantially parallel to the longitudinal axis of the fixing member 10 and moving member 20 combination. The fixing latches 34 formed on the outer side surfaces of the wing members 30 are pushed and brought in tight contact with the inner wall of the ground hole 60 at 910, so that the earth anchor is fastened to some degree in the inner wall of the ground hole 60.

Secondary compressor 70 is engaged causing a second compression that further moves the moving member 20 in a direction of the fixing member 10. The further compression causes the inclined surface 22 to come in contact with the elevated surface 32 which causes the wing member 30 to rotate about the rotational coupler 51 with respect to the longitudinal axis formed by the combination of fixing member 10 and moving member 20. The rotation causes a portion of the wing member 30 farthest from the moving member 20 to move laterally farther with respect to the formed longitudinal axis.

As the wing members 30 move laterally at 912, the wing members 30 are pivotally unfolded on their bottom portions coupled with the rotational pins 40 such that their top portions go away from the fixing member 10. In other words, when the moving member 20 pushes laterally the wing members 30 by way of the first inclined surfaces 22 and the second inclined surfaces 32, the wing members 30 are stopped from the lateral movement by the rotational pins 40 abutting the limits 33 of the sliding slots 33, and the top portions of the wing members 30 are pivoted on the bottom portions coupled with the rotational pins 40.

As shown in FIG. 8, as the wing members 30 are pivotally unfolded, the top portions of the wing members 30 bite deeper (or more deeply penetrate) into the inner wall of the ground hole 60 at 914, and the earth anchor assembly may be thus firmly secured to the ground hole 60. After the earth anchor assembly is fastened and installed in the ground hole 60, concrete or other material may be used to fill the ground hole 60.

While the inventive concept may include being shown and described with reference to exemplary embodiments thereof, it will be apparent to those of ordinary skill in the art that various changes in form and detail may be made thereto without departing from the spirit and scope of the inventive concept as defined by the following claims.

What is claimed is:

1. A multi-stage extending earth anchor assembly for installing in a ground hole, comprising:

a fixing member, the fixing member having an elongated body portion and at least one channel oriented substantially parallel to a longitudinal axis;

a moving member being oriented along the longitudinal axis of the fixing member and being coupled to the fixing member via the at least one channel, the moving member having a base portion and an elongated portion, wherein the elongated portion includes at least one inclined surface;

a primary compressor configured to provide a first movement of the moving member in a direction of the fixing member along a longitudinal axis formed by the combination of the fixing member and moving member such that the fixing member and moving member become compressed;

a plurality of wing members pivotally coupled to the fixing member, wherein each of the plurality of wing members include one or more fixing latches on an outer surface of the plurality of wing members, and wherein the compression causes the plurality of wing members to contact the at least one inclined surface and to move along the at least one inclined surface, causing the plurality of wing members to undergo a lateral movement outward from the longitudinal axis based on the contact between the plurality of wing members and the at least one inclined surface and causing the one or more fixing latches to make contact with an inner wall of the ground hole, a rotational coupler comprising a pin that stops the lateral movement along the at least one channel in response to the rotational coupler abutting a limit of a sliding slot elongated in a lateral direction along which the plurality of wing members an move, a secondary compressor comprising a wire and configured to provide a second movement of the moving member in a direction of the fixing member along a longitudinal axis formed by the combination of the fixing member and moving member such that the fixing member and moving member become further compressed, wherein the further compression causes the wing member to rotate about the rotational coupler with respect to the longitudinal axis of the fixing member, causing a contact between at least one elevated surface of the plurality of wing members and at least one inclined surface of the plurality of moving members; and a plurality of rotational pins configured to pivotally hinge a respective bottom portion of each of the plurality of wing members to the fixing member;

wherein the contact between at least one elevated surface of the plurality of wing members and at least one inclined surface of the plurality of moving members causes the plurality of wing members to rotate about the rotational coupler with respect to the longitudinal axis causing a portion of the plurality of wing members to pivotally unfold with respect to the longitudinal axis, wherein the movement of the portion of the plurality of wing members causes a deeper penetration of the plurality of wing members into the inner wall of the ground hole.

2. The earth anchor assembly of claim 1, wherein the first compressor is a spring.

3. The earth anchor assembly of claim 1, wherein the fixing member and the moving member comprise at least one of stainless steel, aluminum, titanium, plastic, ceramic, or carbon fiber.

* * * * *